US005088936A

United States Patent [19]

Wang

[11] Patent Number: 5,088,936

[45] Date of Patent: Feb. 18, 1992

[54] STRUCTURE OF MULTIPLE CONNECTOR

[76] Inventor: Tsan-Chi Wang, No. 13, Lane 312, Chungcheng Rd., Hsin Tien City, Taipei Hsien, Taiwan

[21] Appl. No.: 643,246

[22] Filed: Jan. 18, 1991

[51] Int. Cl.[5] ..... H01R 9/05; H01R 17/04

[52] U.S. Cl. ..... 439/578; 439/579; 439/583

[58] Field of Search ..... 439/578–580, 439/582, 583

[56] References Cited

U.S. PATENT DOCUMENTS 4,797,121 1/1989 Hayward ..... 439/579
4,806,116 2/1989 Ackerman ..... 439/578
4,897,045 1/1990 Dyck ..... 439/578

FOREIGN PATENT DOCUMENTS 1000558 8/1965 United Kingdom ..... 439/583

*Primary Examiner*—Paula A. Bradley
*Attorney, Agent, or Firm*—Varndell Legal Group

[57] ABSTRACT

A multiple connector comprising a cast iron pipe having terminals disposed in first and second outlets arranged in parallel at one side thereof and a third outlet arranged on an opposite side of the cast iron pipe. The terminals respectively connected through screw joints for connecting multiple telecommunication circuits in parallel.

2 Claims, 3 Drawing Sheets

STRUCTURE OF MULTIPLE CONNECTOR

BACKGROUND OF THE INVENTION

The present invention relates to multiple connectors, and more particularly relates to a multiple connector for connecting multiple telecommunication circuits in parallel which eliminates signal distortion and reduces space occupation.

In offices, schools or public or private organizations, many computers may be connected for on-line operation. A BNC connector is designed for this purpose. However, a BNC connector is not satisfactory in use because it is expensive to manufacture, consumes much cable, and can not effectively eliminate signal distortion during signal transmission.

FIG. 1 illustrates a computer network on-line operation in which the computers are connected through T-connectors via BNC coaxial cable. Because coaxial cable has a certain thickness and hardness, it occupies much space when it is turned in angle. Therefore, when a T-connector is used for connecting multiple telecommunication circuits in parallel, much coaxial cable should be used. Since coaxial cable is very expensive, the installation cost will be high if more coaxial cable is used. When longer coaxial cable is used, it is inevitable that the signal distortion problem will become worse. Further, a regular multiple connector is of fixed type, the outlets of which are not changeable.

SUMMARY OF THE INVENTION

The present invention has been accomplished to eliminate the aforesaid problems. It is therefore an object of the present invention to provide a multiple connector for connecting multiple telecommunication circuits in parallel, which can greatly reduce cable consumption and eliminate signal distortion.

It is another object of the present invention to provide a multiple connector for connecting multiple telecommunication circuits in parallel, which provides adjustable outlets to suit the directions of the telecommunication circuits to be connected.

DETAILED DESCRIPTION OF THE PREFERRED EMBODIMENTS

Figure 1:
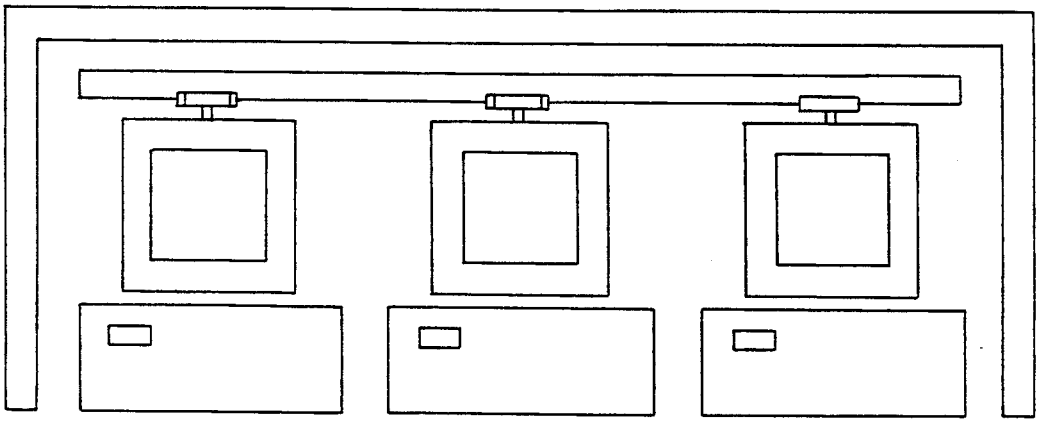
Fig. 1 PRIOR ART
FIG. 1 is a schematic drawing illustrating a computer network on-line connection according to the prior art.
Figures 2, 3:
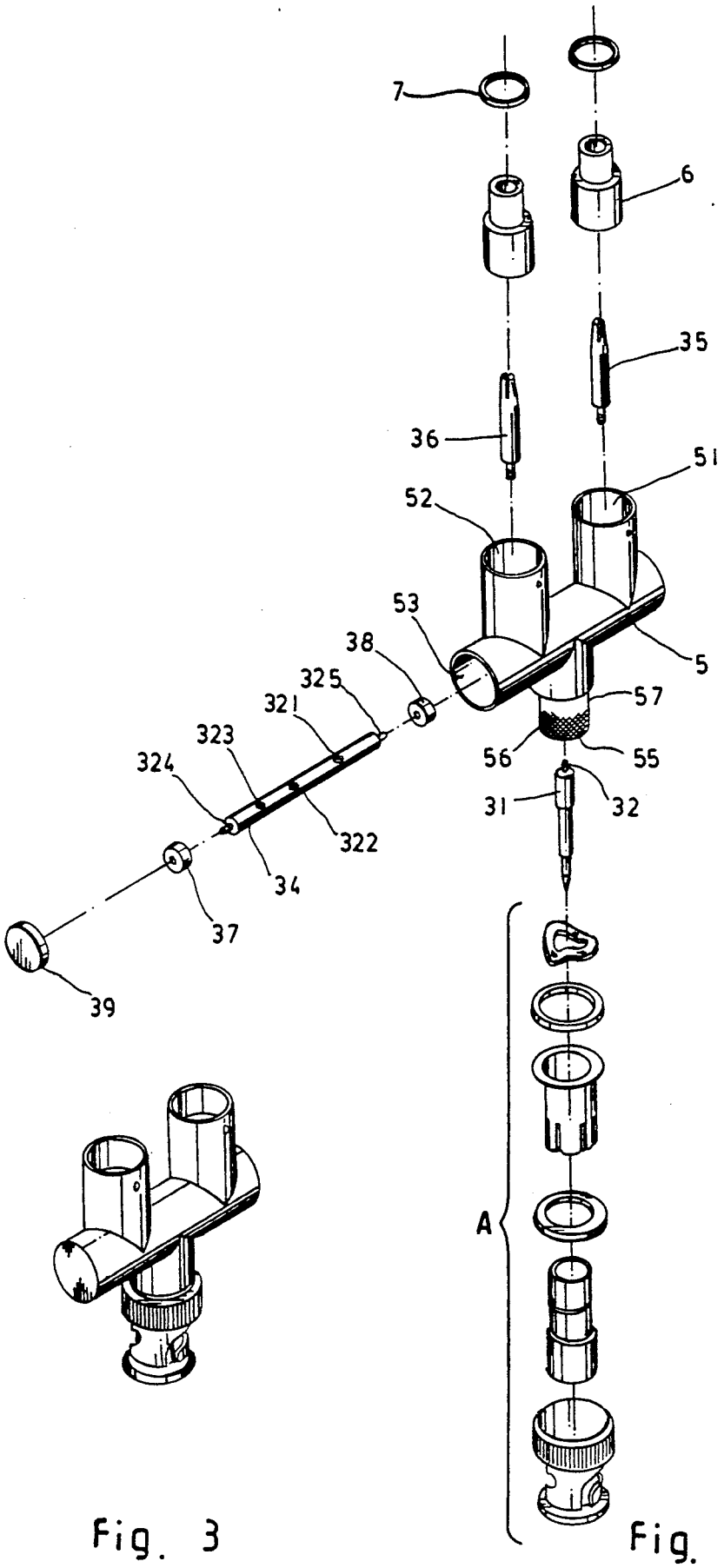
FIG. 2 is a perspective dismantled view of the preferred embodiment of the multiple connector of the present invention.
FIG. 3 is a perspective assembly view of the preferred embodiment of the multiple connector of the present invention.

Referring to FIGS. 2 and 3, a multiple connector is generally comprised of a cast iron pipe 5 having a main terminal mounting hole 53 transversely disposed at the middle, two parallel terminal mounting holes 51 and 52 vertically extending from said main terminal mounting hole 53 at one side, and an intermediate terminal mounting hole 55 vertically extending from said main terminal mounting hole at an opposite side and disposed at a middle position between said two parallel terminal mounting holes 51 and 52. There is provided a long terminal 34 set in the main terminal mounting hole 53, two short terminals 35 and 36 respectively set in the two parallel terminal mounting holes 51 and 52, and an intermediate terminal 31 set in the intermediate terminal mounting hole 55. The long terminal 34 has three bolt holes 321, 322 and 323 respectively disposed in alignment with the holes 51, 55 and 52, and two outer thread portions 324 and 325 at two opposite ends and respectively covered with plastic nuts 37 and 38. After the long terminal 34 is fastened in the hole 53, a cap 39 is covered on the hole 53 to seal out moisture and dust. The short terminals 35 and 36 have each an outer thread portion at one end and respectively fastened in the two outer bolt holes 321 and 323 of the long terminal 34. After the short terminals 35 and 36 are respectively inserted in the holes 51 and 52 and fastened in the bolt holes 321 and 323 of the long terminal 34, two stepped sockets 6 are respectively mounted on the two short terminals 35 and 36, and then, two toothed retainer rings 7 are respectively mounted on said two stepped sockets 6 to firmly retain the two short terminals 35 and 36 inside the cast iron pipe 5. The hole 55 is fastened with a stub tube 57 which has an embossed outer surface portion 56. The intermediate terminal 31 has an outer thread portion 32 at one end. After the stub tube 57 is fastened in the hole 55, the intermediate terminal 31 is then inserted in the stub tube 57 with its outer thread portion 32 fastened in the intermediate bolt hole 322 of the long terminal 34. After the intermediate terminal 31 is fastened in the hole 55, a receptacle assembly A is fastened in the stub tube 57. After assembly, the whole structure has a configuration as shown in FIG. 3.

Figure 4:
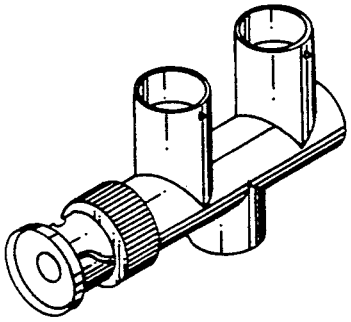
FIG. 4 illustrates an alternate form of the present invention.

As an alternate form of the present invention, the intermediate terminal 31 may be fastened in the hole 53 and connected to the long terminal 34 in series, and the stub tube 57 as well as the receptacle assembly are also connected to the hole 53. Thus, a multiple connector is presented in a substantially F-shaped configuration as shown in FIG. 4.

I claim:

1. For connecting multiple telecommunication circuits in parallel, a multiple connector comprising a cast iron pipe having a first outlet and a second outlet respectively disposed in parallel with each other at one side thereof and a third outlet disposed at an opposite side thereof, a plurality of terminals set inside said cast iron pipe and respectively connection into said first, second and third outlets through screw joints, two stepped sockets respectively fastened in said first and second outlets for holding said terminals in position, two toothed retainer rings respectively fastened in said first and second outlets for holding said two stepped sockets in position, and a cylindrical receptacle assembly fastened in said third outlet.

2. The multiple connector of claim 1, wherein said terminals comprises a long terminal transversely set inside said cast iron pipe at the middle, said long terminal having first and second bolt holes at two opposite ends and respectively aligned with said first and second outlets and a third bolt hole at the middle and aligned with said third outlet, two short terminals respectively disposed in said first and second outlets and having each a threaded end respectively fastened in said first and second bolt holes, and an intermediate terminal disposed in said third outlet and having a threaded end fastened in said third bolt hole.

* * * * *